US005440797A

United States Patent [19]

Wentworth et al.

[11] Patent Number: 5,440,797

[45] Date of Patent: Aug. 15, 1995

[54] METHOD FOR MAKING A PNEUMATIC GROUND PIERCING TOOL

[75] Inventors: Steven W. Wentworth, Brookfield; Robert F. Crane; Jon A. Hass, both of Oconomowoc, all of Wis.

[73] Assignee: Earth Tool Corporation, Oconomowoc, Wis.

[21] Appl. No.: 315,235

[22] Filed: Sep. 29, 1994

Related U.S. Application Data

[60] Continuation-in-part of Ser. No. 878,741, May 5, 1992, which is a division of Ser. No. 591,099, Oct. 1, 1990, Pat. No. 5,199,151, which is a continuation-in-part of Ser. No. 435,953, Nov. 13, 1989, Pat. No. 5,025,868.

[51] Int. Cl.[6] ..... B23P 11/00

[52] U.S. Cl. ..... 29/437; 29/517

[58] Field of Search ..... 29/434, 437, 508, 515, 29/516, 517; 173/17, 91, 134, 137, 139; 72/367, 370; 175/19

[56] References Cited

U.S. PATENT DOCUMENTS 2,309,181 1/1943 Franck .
3,327,513 6/1967 Hinshaw .
3,410,354 11/1968 Sudnishnikov et al. .
3,754,429 8/1973 Creuzet .
3,756,328 9/1973 Sudnishnikov et al. .
4,078,619 3/1978 Sudnishnikov et al. .
4,261,193 4/1981 Boik .
4,662,457 5/1987 Bouplon .

FOREIGN PATENT DOCUMENTS

0484839A2 5/1992 European Pat. Off. .

OTHER PUBLICATIONS

"Automated Swaging Beats Waste", Machine and Tool Blue Book, Bella, Jun. 1988, pp. 46, 47 and 48.
"Materials and Processes in Manufacturing", DeGarmo, 1979, pp. 375, 392 and 393.

*Primary Examiner*—Timothy V. Eley
*Attorney, Agent, or Firm*—Foley & Lardner

[57] ABSTRACT

In a method for making a self-propelled impact boring tool, the tool body is formed by swaging a steel tube to form the tapered nose of the tool. This results in less wasted steel as compared to conventional machining of a solid steel bar to form the body, which is the largest single part of the tool. The tool body may then be fitted with a tool anvil of slightly different dimensions than the forming anvil used during swaging to provide an interference fit.

8 Claims, 3 Drawing Sheets

METHOD FOR MAKING A PNEUMATIC GROUND PIERCING TOOL

This application is a continuation-in-part of U.S. Ser. No. 07/878,741, filed May 5, 1992, which is a division of U.S. Ser. No. 07/591,099, filed Oct. 1, 1990, U.S. Pat. No. 5,199,151, which was a continuation-in-part of U.S. Serial No. 07/435,953, filed Nov. 13, 1989, U.S. Pat. No. 5,025,868.

TECHNICAL FIELD

This invention relates to machine manufacturing methods, particularly to a method for manufacturing pneumatic impact tools.

BACKGROUND OF THE INVENTION

Self-propelled pneumatic tools for making small diameter holes through soil are well known. Such tools are used to form holes for pipes or cables beneath roadways without need for digging a trench across the roadway. These tools include, as general components, a torpedo-shaped body having a tapered nose and an open rear end, an air supply hose which enters the rear of the tool and connects it to an air compressor, a piston or striker disposed for reciprocal movement within the tool, and an air distributing mechanism for causing the striker to move rapidly back and forth. The striker impacts against the front wall (anvil) of the interior of the tool body, causing the tool to move violently forward into the soil. The friction between the outside of the tool body and the surrounding soil tends to hold the tool in place as the striker moves back for another blow, resulting in incremental forward movement through the soil. Exhaust passages are provided in the tail assembly of the tool to allow spent compressed air to escape into the atmosphere.

Most impact boring tools of this type have a valveless air distributing mechanism which utilizes a stepped air inlet. See, for example, Sudnishnikov et al. U.S. Pat. No. 3,410,354, issued Nov. 12, 1968. The step of the air inlet is in sliding, sealing contact with a tubular cavity in the rear of the striker. The striker has radial passages through the tubular wall surrounding this cavity, and an outer bearing surface of enlarged diameter at the rear end of the striker. This bearing surface engages the inner surface of the tool body.

Air fed into the tool enters the cavity in the striker through the air inlet, creating a constant pressure which urges the striker forward. When the striker has moved forward sufficiently far so that the radial passages clear the front end of the step, compressed air enters the space between the striker and the body ahead of the bearing surface at the rear of the striker. Since the cross-sectional area of the front of the striker is greater than the cross-sectional area of its rear cavity, the net force exerted by the compressed air now urges the striker backwards instead of forwards. This generally happens just after the striker has imparted a blow to the anvil at the front of the tool.

As the striker moves rearward, the radial holes pass back over the step and isolate the front chamber of the tool from the compressed air supply. The momentum of the striker carries it rearward until the radial holes clear the rear end of the step. At this time the pressure in the front chamber is relieved because the air therein rushes out through the radial holes and passes through exhaust passages at the rear of the tool into the atmosphere. The pressure in the rear cavity of the striker, which defines a constant pressure chamber together with the stepped air inlet, then causes the striker to move forwardly again, and the cycle is repeated.

In some prior tools, the air inlet includes a separate air inlet pipe, which is secured to the body by a radial flange having exhaust holes therethrough, and a stepped bushing connected to the air inlet pipe by a flexible hose. See Sudnishnikov et al. U.S. Pat. Nos. 3,410,354, issued Nov. 12, 1968 and 4,078,619, issued Mar. 14, 1978.

These tools have been made reversible by providing a threaded connection between the air inlet sleeve and the surrounding structure which holds the air inlet concentric with the tool body. See, for example, Sudnishnikov et al. U.S. Pat. No. 3,756,328, issued Nov. 12, 1968. The threaded connection allows the operator to rotate the air supply hose and thereby displace the stepped air inlet rearward relative to the striker. Since the stroke of the striker is determined by the position of the step, i.e., the positions at which the radial holes are uncovered, rearward displacement of the stepped air inlet causes the striker to hit against the tail nut at the rear of the tool instead of the front anvil, driving the tool rearward out of the hole.

The screw reverse mechanism described in the foregoing U.S. Pat. No. 3,756,328 has proven inconvenient. To reverse the tool, it is often necessary to rotate the air hose as many as 12–18 times. This can prove difficult when the tool has travelled a great distance because of the length of hose that must be rotated.

The foregoing tool also employs a large, heavy tailpiece which is threadedly secured in the rear end of the tool body. In practice this type of tailpiece has proven very difficult to remove, making the tool hard to disassemble for servicing or replacement of worn parts. The '328 tool also utilizes a large, cylindrical shock absorber through which the exhaust passages are formed. This shock absorber must generally be bonded to the adjoining casing and tailpiece, again rendering the tool difficult to assemble and disassemble.

The tailpiece of the '328 tool and other conventional tools has a rearward tapered rear portion with a central circular hole through which the air hose extends. As shown in Bouplon U.S. Pat. No. 4,662,457, issued May 5, 1987, the hose is generally secured to the air inlet by a metal coupling. Exhaust air must pass between the metal coupling and the rim of the tailpiece in order to escape from the tool. During reverse movement, small stones can become jammed in the space between the coupling and the tailpiece, making it impossible to rotate the hose to switch modes.

The tool body of the foregoing known tools is generally made from a solid steel bar which is drilled out to form the tubular tool body. This method of fabricating the tool body is results in a large amount of wasted material, increasing substantially the cost to manufacture such a tool. The front end of the tool body is machined so that it tapers forwardly to from part of the nose of the tool. An anvil which provides the impact surface for the striker is secured in open front end of the tool. Threads for securing the tailpiece are machined on the inner surface of the tool body at the rear end opening of the tubular body. The tool can then be assembled by inserting the striker into the tool, and then installing the air distributing mechanism in behind the striker. The threaded connection between the tailpiece and the body secures the striker and air distributing mechanism.

Swaging is a widely practiced process for shaping metal parts. Parts such as piston rods, gas cylinders and other tapered tubular and cylindrical parts can be made by swaging. See Machine and Tool BLUE BOOK, June, 1988, pp. 46–48 and DeGarmo, *Materials and Processes in Manufacturing*, 5th Ed., pp. 275, 393—393, 1979. The present invention utilizes swaging as part of an improved process for making impact boring tools.

SUMMARY OF THE INVENTION

The present invention provides a method for making a self-propelled impact boring tool wherein the tool body is formed by swaging a steel tube to form the tapered nose of the tool. This process results in less wasted steel as compared to conventional machining of a solid steel bar to form the body, which is the largest single part of the tool.

BRIEF DESCRIPTION OF THE DRAWING

The invention will hereafter be described with reference to the accompanying drawing, wherein like numerals denote like elements, and.

DETAILED DESCRIPTION OF PREFERRED EMBODIMENTS

Figure 1:
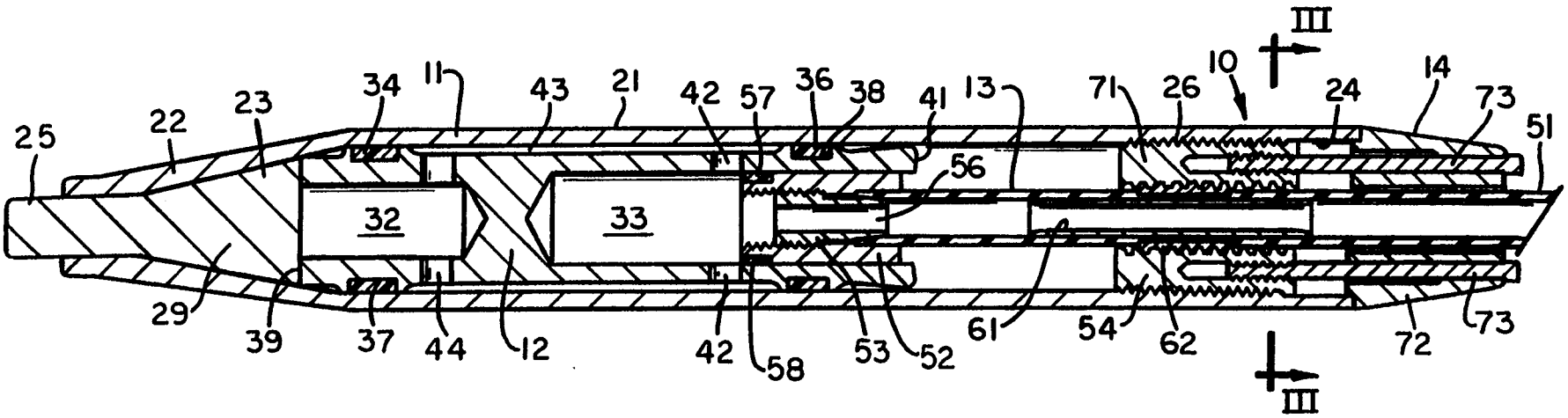
FIG. 1 is a lengthwise sectional view of an impact boring tool according to the invention.

Referring now to FIG. 1, a pneumatic ground piercing tool 10 which can be made according to the process of the invention includes, as main components, a tool body 11, a striker 12 for impacting against the interior of body 11 to drive the tool forward, a stepped air inlet conduit 13 which cooperates with striker 12 for supplying compressed air to reciprocate striker 12, and a tail assembly 14 which allows exhaust air to escape from the tool, secures conduit 13 to body 11, and provides a threaded connection to allow reverse operation. Each of these components will now be described in detail.

Tool body 11 comprises a cylindrical hollow housing 21 having a tapered nose 22. Nose 22 can be made by swaging a front end portion of a tubular steel pipe against a frontwardly tapering, generally frustoconical forming anvil, as described below. Striker 12 is disposed for sliding, back-and-forth movement inside of tool body 11 forwardly of conduit 13 and tail assembly 14. Striker 12 comprises a cylindrical rod having frontwardly and rearward opening blind holes (recesses) 32, 33 respectively therein. A pair of plastic, front and rear seal bearing rings 34, 36 are disposed in corresponding annular grooves 37, 38 in the outer periphery of rod 31 for supporting striker 12 for movement along the inner surface of body 11. Annular front impact surface 39 impacts against anvil 23 when the tool is in forward mode, as shown in FIG. 1, and an annular rear impact surface 41 impacts against tail assembly 14 when the tool is in rearward mode.

A plurality of rear radial holes 42 allow communication between recess 33 and the annular space 43 between striker 12 and body 11 bounded by seal rings 34, 36. A second set of front radial holes 44 allow communication between space 43 and front recess 32. Annular space 43, holes 44, front recess 32 and the interior space of body 11 ahead of striker 12 (after striker 12 has moved backwards from the position shown in FIG. 1) together comprise the front, variable pressure chamber of the tool. Anvil 23 may optionally have a narrow central air passage (not shown) allowing limited communication between the front pressure chamber and the front end of the tool for injecting air into the hole being formed to loosen the soil ahead of the tool.

Referring now to FIGS. 1 through 5, stepped air inlet conduit 13 includes a flexible hose 51, a tubular bushing 52 fitted with an inner locking nut 53, and an adjuster screw mechanism 54. Hose 51, which may be made of rubberized fabric, is secured by a coupling (not shown) to a further length of hose which ultimately connects tool 10 with the air compressor. The inner end of hose 51 is clamped to the inner wall of bushing 52 by nut 53, which is threadedly coupled with bushing 52. Nut 53 has a bore 56 which allows compressed air to pass from hose 51 through nut 53 and bushing 52 into cavity 33. In the alternative, hose 51 may be adhesively bonded directly to the interior of bushing 52, and nut 53 may be omitted.

The cylindrical outer surface of bushing 52 is inserted into cavity 33 in slidable, sealing engagement with the wall thereof. Cavity 33 and the adjoining interior space of stepped conduit 13 together comprise a rear, constant pressure chamber which communicates intermittently with the front, variable pressure chamber by means of holes 42. Bushing 52 may, if needed, have a plastic bearing ring 57 disposed in an annular peripheral groove 58 to reduce air leakage between bushing 52 and the wall of cavity 33.

Figure 4:
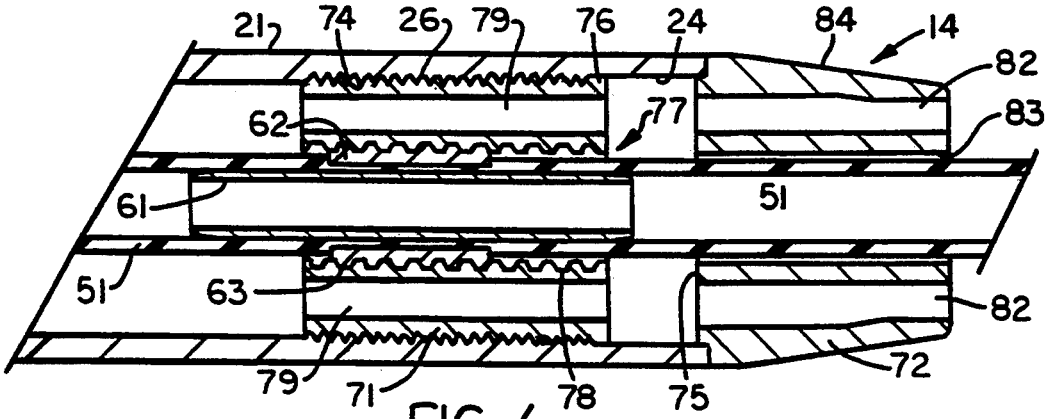
FIG. 4 is a partial, enlarged sectional view taken along the line IV—IV in FIG. 2.
Figure 5:
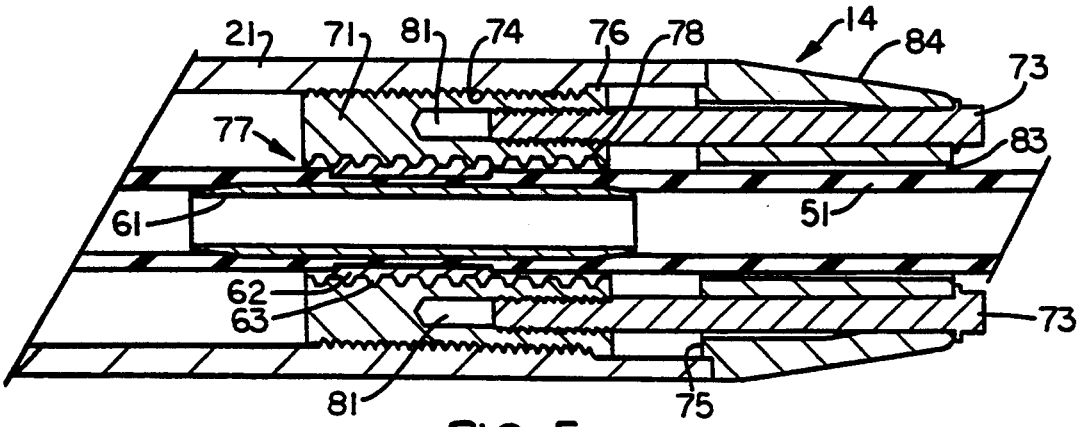
FIG. 5 is a partial, enlarged sectional view taken along the line V—V in FIG. 2.
Figure 6:
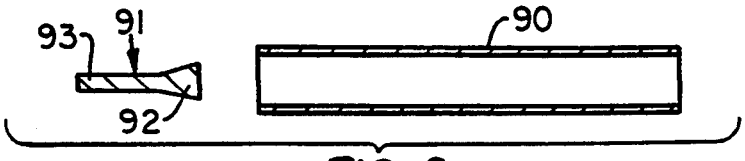
FIG. 6 is a lengthwise sectional view of an anvil and tube assembly for use in the method of the invention.

Adjuster screw mechanism 54 includes a tubular inner sleeve 61 disposed inside of hose 51 and a coaxial outer sleeve 62 which has outer peripheral threads 63 for securing the stepped conduit 13 to tail assembly 14, as described below. Hose 51 is clamped under compression between sleeves 61, 62 as shown in FIGS. 4 and 5. Outer sleeve 62 may, in addition, be secured to the outside of hose 51 by an adhesive. If the adhesive bond is sufficiently strong, inner sleeve 61 may be omitted. The foregoing structure renders mechanism 54 light in weight, which reduces the effect of axial shocks transmitted thereto through sleeve 62 and helps eliminate the need for a shock dampening coupling. For this purpose, bushing 52 is preferably made of a light-weight material such as aluminum, and outer sleeve 62 is made as short as possible, e.g. only about half or less the length of the threaded hole in which it is mounted. Sleeve 62 preferably is only long enough to provide enough screw thread turns to effect the operating mode change, i.e., about 6 or less.

Tail assembly 14 includes a tail nut (rear anvil) 71 and a end cap (cone) 72 secured together by bolts 73. Tail nut 71 has outer peripheral threads 74 in engagement with threads 26 on the interior of housing 21, and an end flange 76 for retaining nut 71 in a counterbore 24. Nut 71 further has a central hole 77 having screw threads 78 in engagement with threads 63 of sleeve 62. Threads 78 have blind front ends so that movement of sleeve 62 is limited to the forwardmost position shown in FIG. 1. Threads 78 open rearward so that air inlet conduit 13 can be unscrewed and removed from nut 71. An inner end boss 75 of cap 72 limits rearward movement of sleeve 62 to a rearwardmost position when cap 72 is secured to nut 71 so that sleeve 62 cannot become disengaged from nut 71 during operation.

According to a preferred embodiment of the invention, threads 63, 78 are formed in a double helix having a helix angle in the range of about 7 to 10 degrees, particularly 8 to 9.5 degrees. The double helix threading provides the connection with additional strength, while allowing a large axial displacement for each turn of hose 51. The large helix angle reduces the tendency of the threaded coupling to become locked, but is not so large that the adjuster screw mechanism will unscrew too easily. Threads 63, 78 preferably have a height and width of at least about 0.1 inch, especially 0.1 to 0.25 inch, to provide a stronger coupling better able to withstand shocks transmitted through nut 71 from the tool body.

Figure 3:
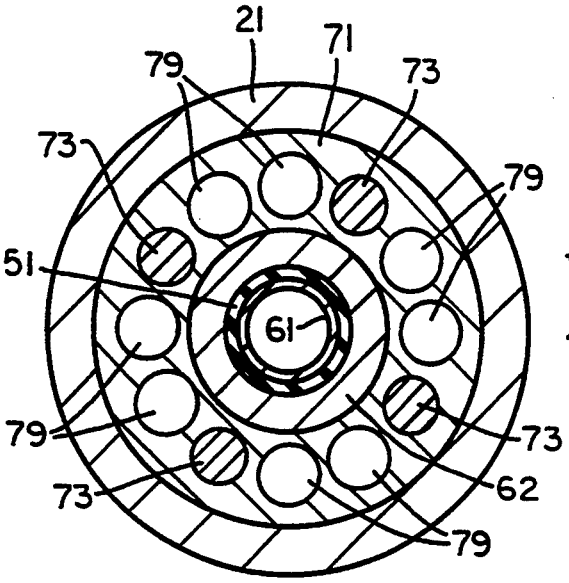
FIG. 3 is a cross-sectional view taken along the line III—III in FIG. 1.
Figure 2:
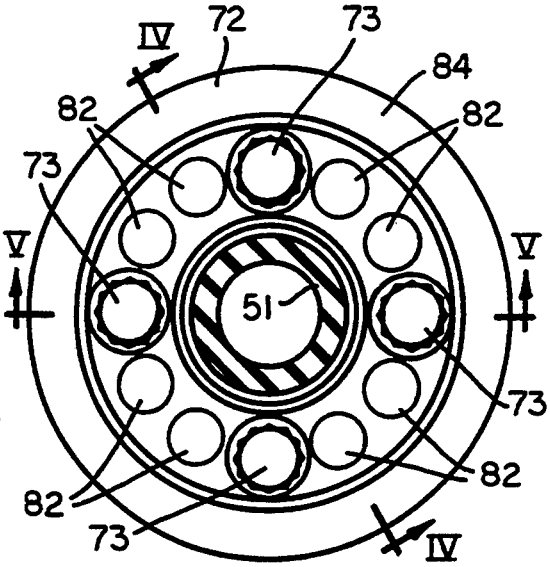
FIG. 2 is a rear view, showing the air hose in section, of the tool shown in FIG. 1.

Tail nut 71 is provided with a plurality of exhaust passages 79 and blind threaded holes 81 for receiving bolts 73. Passages 79 and holes 81 are parallel to each other and to central hole 77, and are most advantageously arranged in a circular formation as shown in FIGS. 2 and 3. Since the power of the tool increases as the cross-sectional area of the exhaust passages increases, this construction allows tool power to be maximized without weakening nut 71 excessively. Prior tools employing large resilient shock absorbers having exhaust passages formed therein are more limited in the area available for forming exhaust passages. The present invention, by eliminating the need for a large resilient shock absorber to protect the screw reverse connection from shocks, provides a more powerful tool.

Tail cap 72 has a series of exhaust openings 82 preferably of the same dimensions as exhaust passages 79. Openings 82 prevent stones from becoming jammed between the tail assembly and the hose coupling, referred to above, which is behind the tool instead of inside the tailpiece as in prior tools. Cap 72 also has a large central hole 83 through which hose 51 passes, and a rearward tapering outer surface 84 to facilitate reverse movement.

The foregoing tail assembly further enhances the serviceability of the tool. The large, unitary tail pieces used in prior tools must be tightly secured in the rear end of the tool body in order to ensure that the tail piece will remain in place during use. The torque required to unscrew the tailpiece is great, making the tool very difficult to take apart. By contrast, bolts 73 can provide the needed clamp load to lock the tail assembly in position, but require far less torque to unscrew. Once bolts 73 have been loosened, nut 71, cap 72 and bolts 73 can be easily turned in unison to remove the tail assembly.

Referring now to FIGS. 6 through 9, the process of the invention begins with a metal tube or pipe 90 from which body 11 will be made and a forming anvil 91 which will be use to shape tube 90 during swaging. Tube 90 is made of a suitable metal, such as AISI 4140 steel. Forming anvil 91 has a forwardly tapering, frustoconical rear portion 92 which seats against the inner surface of a front end portion of tube 90, and a cylindrical shank (front portion) 93 which extends out of the front end opening of tube 90. The exterior of anvil 91 has the shape of the front inner surface of body 11 to be formed.

Figure 7:
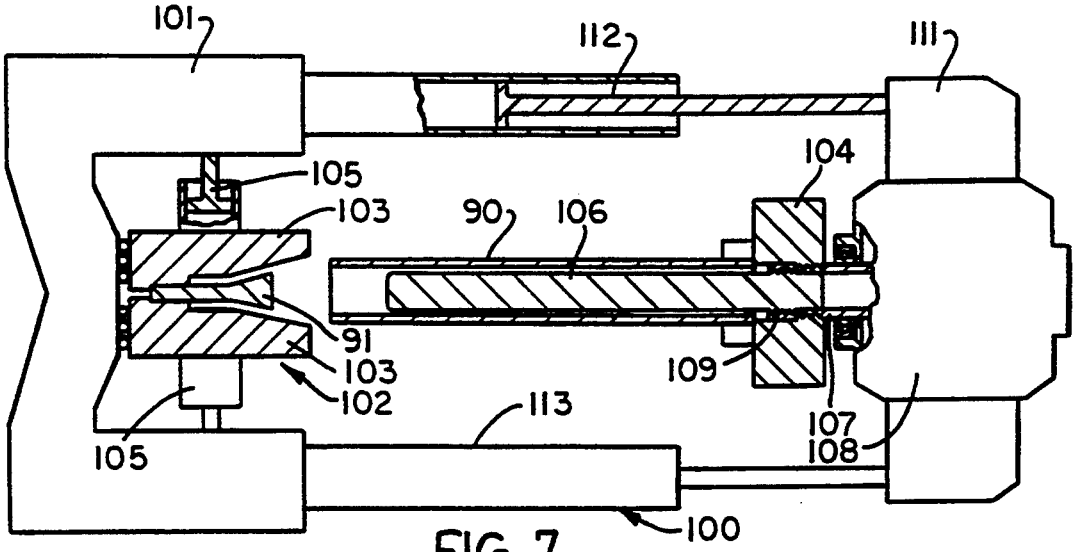
FIG. 7 is a partly broken away top plan view of an apparatus for swaging a tool body according to the invention, prior to insertion of the workpiece into the die.
Figure 8:
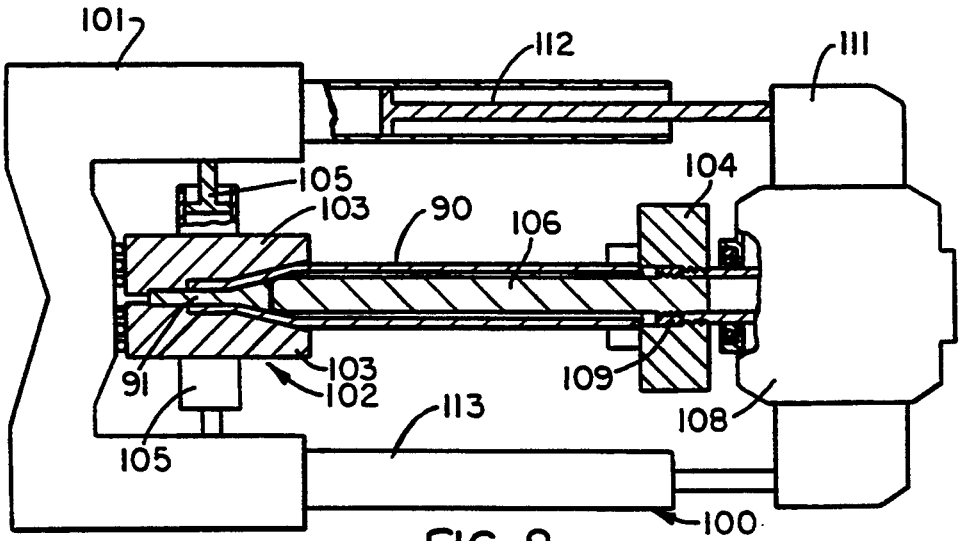
FIG. 8 is the same view as FIG. 7, after the swaging operation has been completed.

Referring to FIGS. 7 and 8, a conventional rotary swaging apparatus 100 includes a fixed frame 101 on which a die assembly 102 is mounted. Die assembly 102 includes a pair of dies 103 actuated by hydraulic cylinders 105. Dies 103 are shaped to form the desired external shape of nose 22 of body 11. Anvil 91 is inserted between dies 103, e.g., in a collet (not shown), and hydraulic cylinders 105 are actuated to clamp anvil 91 between dies 103 as shown.

Tube 90 is mounted in a chuck 104 over an elongated rod 106 which engages anvil 91 during swaging, as shown in FIG. 8. Chuck 104 is threadedly secured to a drive shaft 107 of a motor 108. Rod 106 has a threaded rear end on which a screw collar 109 is mounted. Collar 109 abuts against drive shaft 107 for securing rod 106 in the desired position.

Motor 108 and all of parts 104, 106, 107, 109 are mounted on a movable frame 111 which is connected to fixed frame 101 through a pair of hydraulic cylinders 112, 113. As shown in FIG. 8, tube 90 is forced against dies 103 under several hundred tons of pressure during swaging through the action of cylinders 112, 113. At the same time, motor 108 rotates tube 90 at a high speed, e.g., 100 rpm, so that the end of tube 90 is radially symmetrical.

According to a preferred form of the invention, tube 90 has an outer diameter in the range of 2–6 inches. The thickness of the wall of tube 90 ranges from about 0.31 inch (for 2" OD) to 0.75 inch (for a 6" OD). Tube 90 is heated to a temperature in the range of 1000°–1200° F., especially 1100° F., immediately prior to swaging to improve the formability of the metal.

The swaging process forms the front end portion of tube 90 into a frustoconically tapered shape on both of its inner and outer surfaces, and the swaged front end opening of the resulting body 11 has the same diameter as the cylindrical shank of the forming anvil 91. After swaging is completed, the resulting assembly of tube 90 and anvil 91 are removed from apparatus 100.

Figure 9:
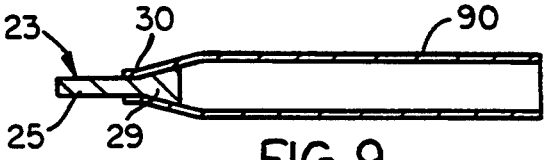
FIG. 9 is a lengthwise sectional view of an anvil and body assembly according to the invention.

Anvil 91, the forming anvil, may be left in place to form the anvil of the finished tool body, or may be removed and replaced with a second anvil of slightly different dimensions. In this case, forming anvil 91 is removed, and the swaged housing is reheated. The second anvil 23 is then inserted into the swaged tube 90 as shown in FIG. 9. Anvil 23 is nearly identical in shape to the forming anvil 91, except that it has a cylindrical shank (front end portion) 25 which has a slightly greater diameter than the corresponding shank 93 of forming anvil 91. In particular, shank 25 of tool anvil 23 has a diameter slightly greater than the associated front opening of the body 11 so that the tool anvil 23 is interference-fitted therein. This assures that anvil 23 will remain securely coupled to housing 21 during use of the tool.

According to a further modified method of the invention, the forming anvil may be omitted altogether, and tube 90 may be swaged using external dies 103 only. It has been found that the resulting tool body can be formed to the proper profile solely by the external force exerted by the dies. The conditions for swaging remain substantially the same as for swaging using a forming anvil. However, this method is most successful with relatively small diameter tubes, for example, 2–3 inch diameter tools, where a smaller reduction in tube diameter is required. As the ratio of the outer diameter of the unreduced portion of the tube to the outer diameter of the fully reduced front end of the tube exceeds about 3:2, swaging according to the invention without using a forming anvil causes material to gather on the tapered inner surface of the tube, making the inner surface uneven. This problem can be overcome, if necessary, by machining the inside of the front end of the swaged tool body to eliminate unevenness before installing the tool anvil. Once the tool body has been formed, the tool anvil 23 is then mounted in its front end opening as described above.

Frustoconical rear end portion 92 and the corresponding inner and outer surfaces of the front end of body 11 generally define an included angle of 20–25 degrees relative to the lengthwise axis of anvil 23. However, according to a further aspect of the invention, an included angle in the range of about 9 to 11 degrees can be used to make the anvil self-locking. This can be done as an alternative to an interference fit between the shank 25 of tool anvil 23 and the associated front opening of the body 11. Since it is desirable to maintain a 20–25 degree taper on the outer surface of body 11, the inner surface of the front end of body 11 is machined to a 9–11 degrees after swaging so that the front end of body has a 9–11 degree taper on the inside and a 20–25 degree taper on the outside.

A front shoulder 30 of rear portion 29 adjacent cylindrical shank 25 is slightly undercut (has a reduced diameter concave surface) in comparison to the corresponding front end of rear portion 92 of forming anvil 91. This ensures that the rear end of rear portion 29, having the largest diameter, will seat securely against the interior of body 11. If the reverse occurs, i.e., the front end seats and the rear end does not, anvil 23 may bend when hit by striker 12 and ultimately fail.

The rear end of the pipe 90 is then cut to size, and the interior of housing 21 is then machined to provided counterbore 24 of slightly enlarged inner diameter. Screw threads 26 are then cut on the interior surface of housing 21 inwardly of but near to counterbore 24 to allow the tail assembly to be secured thereto.

Striker 12 is then inserted into body 11 through the through the rear end opening of body 11, and then the air distributing mechanism, including air inlet conduit 13 and tail assembly 14, is installed in the body behind the striker. Tail assembly 14 is threadedly coupled in the rear end opening of the body and locked (clamp-loaded) in position by means of bolts 73, as described above.

The foregoing method of forming body 11 according to the invention substantially reduces the amount of material (steel) needed to make tool 10. The swaged tool body also has superior mechanical properties as compared to machined tool bodies, particularly improved strength and reduced body distortion. In a pneumatic impact tool of the type described above, the striker impacts against the front end of the tool body. Accordingly, it is particularly important that the tapered front end portion of the tool body have superior strength. Swaging according to the invention achieves this because swaging produces an uninterrupted grain flow that conforms to the tapered shape of the front end of the body. This allows fabrication of a more powerful, durable tool.

According to a further embodiment of the invention, the foregoing procedure can be carried out, particularly on small diameter tubes of about 1–3 inches OD, without rotary swaging. According to this method a unitary circular die is used. The forming anvil is secured rigidly in the die, or may be omitted as noted above. The front end of the tube to be formed is then preheated to a workable temperature, such as 1100°–1300° F. for AISI 4140 steel. Drawn-over-mandrel (DOM) steel tubes are particularly suitable. The open rear end of the tube is clamped by a 3-jaw chuck, and the hot front end of the tube is forced between the anvil and the die by the application of 10 or more tons of pressure, without rotation. This method is simpler than rotary swaging and requires less extensive equipment.

It will be understood that the foregoing description is of preferred exemplary embodiments of the invention, and that the invention is not limited to the specific forms shown. For example, anvil 23 may be lengthened to include a cylindrical rear portion which fits closely within the body immediately behind the tapered front end of the body. This and other modifications may be made in the design and arrangement of the elements without departing from the scope of the invention as expressed in the appended claims.

I claim:

1. A method of making an pneumatic ground piercing tool, which tool comprises a tubular body having a tapered nose at a front end thereof, a striker disposed for reciprocation within said body to impart impacts thereto for driving the body through the ground, an air distributing mechanism for effecting reciprocation of said striker, and a tail assembly mounted in a rear end opening of said body for securing the striker and air distributing mechanism in the body, which method comprises:

forcing a front end portion of a tubular metal body into a frustoconically tapered shape on both the inner and outer surfaces thereof;

installing an anvil in the front end opening of the swaged tube, the anvil having a frustoconical rear portion which seats against the inner surface of said front end portion and a cylindrical shank which extends out of the front end opening;

inserting the striker into the body through the rear end opening of the body;

installing the air distributing mechanism in the body behind the striker; and securing the tail assembly in the rear end opening of the body.

2. The method of claim 1, wherein the forcing step further comprises swaging the front end portion of the tubular metal body using an external die free of an internal forming anvil.

3. The method of claim 1, further comprising the steps of:

machining a series of threads on the inner surface of the rear end portion of said body; and threadedly coupling the tail assembly in the rear end opening of the body.

4. The method of claim 3, further comprising the step of locking the tail assembly to the body by applying an axial clamp load thereto after the tail assembly is threadedly coupled with the body.

5. A method of making a body for a pneumatic ground piercing tool, which body comprises a metal tube having a tapered end portion and an anvil having a frustoconical rear portion which seats against the inner surface of said end portion and a cylindrical shank which extends out of the front end of said metal tube, comprising:

forcing a front end portion of a metal tube to form said end portion into a frustoconically tapered shape on both the inner and outer surfaces thereof; and installing an anvil in the front end opening of the swaged tube, the anvil having a frustoconical rear portion which seats against the inner surface of said front end portion and a cylindrical shank which extends out of the front end opening.

6. The method of claim 5, wherein the forcing step further comprises swaging the front end portion of the metal tube using an external die free of an internal forming anvil.

7. The method of claim 5, wherein the cylindrical front end of the anvil has a diameter slightly greater than the associated front opening of the body so that the anvil is interference-fitted therein.

8. The method of claim 5, wherein the body comprises a steel tube having an outer diameter in the range of from 2 to 6 inches and a substantially uniform wall thickness of from about 0.31 to 0.75 inch.

* * * * *